US008570119B2

(12) United States Patent
Do et al.

(10) Patent No.: US 8,570,119 B2
(45) Date of Patent: Oct. 29, 2013

(54) ULTRA WIDE PASS-BAND, ABSORPTIVE BAND-REJECT FILTER

(75) Inventors: Ky-Hien Do, Toronto (CA); Kevin Miyashiro, Honolulu, HI (US); Neil Kamikawa, Honolulu, HI (US)

(73) Assignee: Terasys Technologies LLC, Honolulu, HI (US)

( * ) Notice: Subject to any disclaimer, the term of this patent is extended or adjusted under 35 U.S.C. 154(b) by 391 days.

(21) Appl. No.: 12/975,513

(22) Filed: Dec. 22, 2010

(65) Prior Publication Data

US 2012/0161904 A1 Jun. 28, 2012

(51) Int. Cl.
*H01P 1/20* (2006.01)
*H01P 5/12* (2006.01)

(52) U.S. Cl.
USPC ..... 333/202; 333/117

(58) Field of Classification Search
USPC ..... 333/117, 120, 121, 126, 132, 174, 175, 333/176, 202; 348/21, 484, 486, 487, 723, 348/724
See application file for complete search history.

(56) References Cited

U.S. PATENT DOCUMENTS 3,252,113 A * 5/1966 Veltrop ..... 333/110
5,101,171 A * 3/1992 Redmond ..... 330/124 R

FOREIGN PATENT DOCUMENTS

DE 3709169 A1 * 9/1988

OTHER PUBLICATIONS

R. Wu, S. S Amari, and U. Rosenberg, "New Cross-Coupled Microstrip Band Reject Filters" 2004 IEEE MTT-S Digest, pp. 1597-1600.*
R. K. Settaluri, A. Weisshaar, C. Lim, and V.K. Tripathi, "Compact Multi-Level Folded Coupled Line RF Couplers", 1999 IEEE MTT-S Digest, pp. 1721-1724.*
Y. Liu, L. Yu, W. Dou, "A Novel Tuning Structure for Bandstop Filter", 2006 IEEE MTT-S Digest, pp. 1245-1248.*

* cited by examiner

*Primary Examiner* — Dean O Takaoka
(74) *Attorney, Agent, or Firm* — Leighton K. Chong

(57) ABSTRACT

An ultra wide band-pass, absorptive band-reject filter has a pair of quadrature hybrid couplers cascaded and coupled by a phase shifting element and a matched pair of band-reject filters in two parallel paths. The matched pair of band-reject filters each rejects signals in a desired reject frequency band. The quadrature hybrid couplers each have an insertion loss amplitude crossover for signals propagated to terminals across the coupler that coincides with the reject frequency band. The phase shifting element is configured to have a phase shift of 180 degrees at frequencies in the reject frequency band. In a preferred embodiment, the pair of quadrature hybrid couplers are identical in performance and the band-reject filters are identical in performance with respect to a center frequency fn of the reject frequency band. The absorptive band-reject filter thereby provides an absorptive rejection response in the reject frequency band while a very wide pass-band frequency range is maintained.

13 Claims, 13 Drawing Sheets

ULTRA WIDE PASS-BAND, ABSORPTIVE BAND-REJECT FILTER

TECHNICAL FIELD

This invention generally relates to band-reject filters and, more particularly, to an ultra wide band-pass, absorptive band-reject filter that can operate over a maximum to minimum frequency range ratio exceeding 100:1.

BACKGROUND ART

Wireless technology has become an integral part of society with widespread use of such devices as the pager and cellular phone, as well as networking technology such as wireless routers. With the explosion in use of wireless technology, there are many instances where a nearby wireless transmitter may interfere with an adjacent receiver. Under these circumstances, it is possible to remove the offending transmitter signal at the receiver's frequency by placing a band-reject filter at the output of the transmitter and tuning the band-reject filter to the frequency of the adjacent receiver.

Band reject filters find utility in canceling interference in a number of wireless technologies such as cellular phone, wireless routers, hand-held radios, satellite communications, and any other situation where there may be a number of wireless devices in close proximity. Conventional, non-absorptive filters reflect power at frequencies in the reject band, which can create undesirable electromagnetic interference, as well as, damage electronic components if the reflected power is too large. As the radio frequency (RF) power level of transmitters increase, it becomes a problem to use conventional band-reject filters.

An example of a commercially available conventional band-reject filter is Model U2916 band-reject filter offered by Delta Microwave Inc. at 300 Del Norte Boulevard, Oxnard, Calif. 93030. As illustrated in FIG. 1, the high return losses 1 of such conventional filters in the reject band are the result of the power at frequencies in the reject band being reflected back to the transmitter. The insertion losses 2 are also shown in FIG. 1. At low RF power levels, the reflected power can interact with the transmitted power to create interference signals known as intermodulation distortion products. At high RF power levels, the reflected power can physically damage the transmitter.

While it may be desirable to provide a band-reject filter with an absorptive response, it is also desirable to have a pass-band over a very wide frequency range because RF systems can operate over a maximum-to-minimum frequency range ratio exceeding 100:1. For example, modern digital radios, each operating over several octaves of frequencies, can be multiplexed together to cover very wide frequency ranges. There have been published methods for achieving band-reject filters or wide bandwidth all-pass networks, but none have reported the ability to create an absorptive notch filter with a pass-band that operates over a very wide (100:1 or more) frequency range. Therefore, there is a need for an absorptive band-reject filter that also operates with a pass-band over a very wide (100:1 or more) frequency range bandwidth.

In other prior art, U.S. Pat. No. 3,748,601, entitled "Coupling Networks Having Broader Bandwidth than Included Phase Shifters", issued to Harold Seidel on Jul. 24, 1973, describes a technique for extending the bandwidth of a quadrature hybrid coupler using a phase shifter. However, this disclosure does not provide the advantages of a wide pass-band, absorptive band-reject filter that reduces the insertion loss of the quadrature hybrid coupler and the overall topology.

U.S. Published Patent Application 2009/0289744, entitled "Electronically Tunable, Absorptive, Low-Loss Notch Filter", filed in the name of Kevin Miyashiro, and owned in common with the present patent application, describes a technique for creating an absorptive band-reject filter, but its bandwidth is limited by the quadrature hybrids used.

FIG. 12 illustrates pass-bands of three different all-pass networks. The dotted line plot 33 indicates a wide frequency pass band range for an all-pass network. FIG. 13 illustrates the components in a conventional all-pass network having two cascaded quadrature hybrid couplers 3 and 7 in parallel coupled in one path by a 180-degree phase shifter 4, similar to that described in U.S. Pat. No. 3,748,601. However, the all-pass network of the prior art cannot perform the band-reject function to prevent interference from a transmitter on an adjacent receiver while maintaining the wide pass-band. When quadrature hybrid couplers are used in a shunt configuration as described in U.S. Published Patent Application 2009/0289744, an absorptive response in the reject band is achieved, but the pass-band is limited to frequency ranges of 20:1 because the response is limited by the bandwidth of the quadrature hybrid couplers. The solid line 34 in FIG. 12 indicates the pass band using this technique, but it does not extend to low frequencies. The wide pass band also cannot be achieved by cascading two quadrature hybrid couplers without a phase shifter in one of the parallel paths. The dashed line 35 in FIG. 12 indicates that the frequency range with this technique is also limited and does not extend to low frequencies.

U.S. Pat. No. 7,323,955, entitled "Narrow-band Absorptive Bandstop Filter with Multiple Signal Paths," issued to Douglas R. Jachowski on Jan. 29, 2008, describes a technique for achieving absorptive band-reject filters using a quarter-wave transmission line, but whose band-pass bandwidth is limited by the narrow bandwidth of the quarter-wave transmission line.

SUMMARY OF INVENTION

In the present invention, an ultra wide band-pass, absorptive band-reject filter comprises a pair of quadrature hybrid couplers cascaded and coupled by a phase shifting element and a matched pair of band-reject filters in two parallel paths. The matched pair of band-reject filters each rejects signals in a desired reject frequency band. The quadrature hybrid couplers each have an insertion loss amplitude crossover for signals propagated to terminals across the coupler that coincides with the reject frequency band. The phase shifting element is configured to have a phase shift of 180 degrees at frequencies in the reject frequency band. In a preferred embodiment, the pair of quadrature hybrid couplers are selected to be identical in performance and the band-reject filters are also selected to be identical in performance with respect to a center frequency fn of the reject frequency band. The absorptive band-reject filter thereby provides an absorptive rejection response in the reject frequency band while a very wide pass-band frequency range is maintained.

Other objects, features, and advantages of the present invention will be explained in the following detailed description of the invention having reference to the appended drawings.

DESCRIPTION OF PREFERRED EMBODIMENTS

In the following detailed description of the invention, certain preferred embodiments are illustrated providing certain specific details of their implementation. However, it will be recognized by one skilled in the art that many other variations and modifications may be made given the disclosed principles of the present invention.

Figure 2:
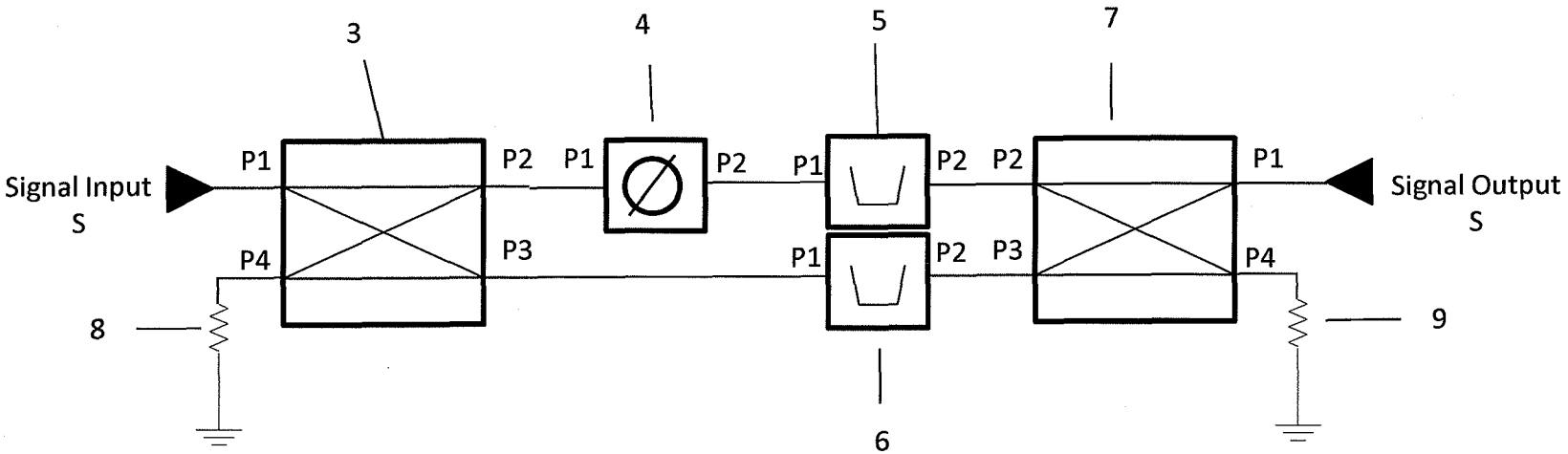
FIG. 2 illustrates an ultra wide band-pass, absorptive band-reject filter having components configured in accordance with the present invention.

FIG. 2 illustrates an ultra wide band-pass, absorptive band-reject filter comprised of a pair of quadrature hybrid couplers 3, 7, which are cascaded and coupled by a phase shifting element 4 and a matched pair of band-reject filters 5, 6. The first quadrature hybrid coupler 3 has terminals numbered P1, P2, P3, and P4, and the second quadrature hybrid coupler 7 similarly has terminals numbered P1, P2, P3, and P4. The terminal P1 of the first quadrature hybrid coupler 3 receives the Signal Input to the circuit network, and terminal P4 thereof is terminated in a resistive load 8. The terminal P1 of the second quadrature hybrid coupler 7 provides the Signal Output from the circuit network, and terminal P4 thereof is terminated in a resistive load 9. A first band-reject filter 5 has terminals numbered P1 and P2 which are connected between one parallel path coupling the P2 terminals of the first and second quadrature hybrid couplers 3 and 7. A second band-reject filter 6 has terminals numbered P1 and P2 which are connected between the other parallel path coupling the P3 terminals of the first and second quadrature hybrid couplers 3 and 7. A differential phase shifter 4 has terminals numbered P1 and P2 and is connected in series on one of the parallel paths coupling the first and second quadrature hybrid couplers 3 and 7.

Figure 3:
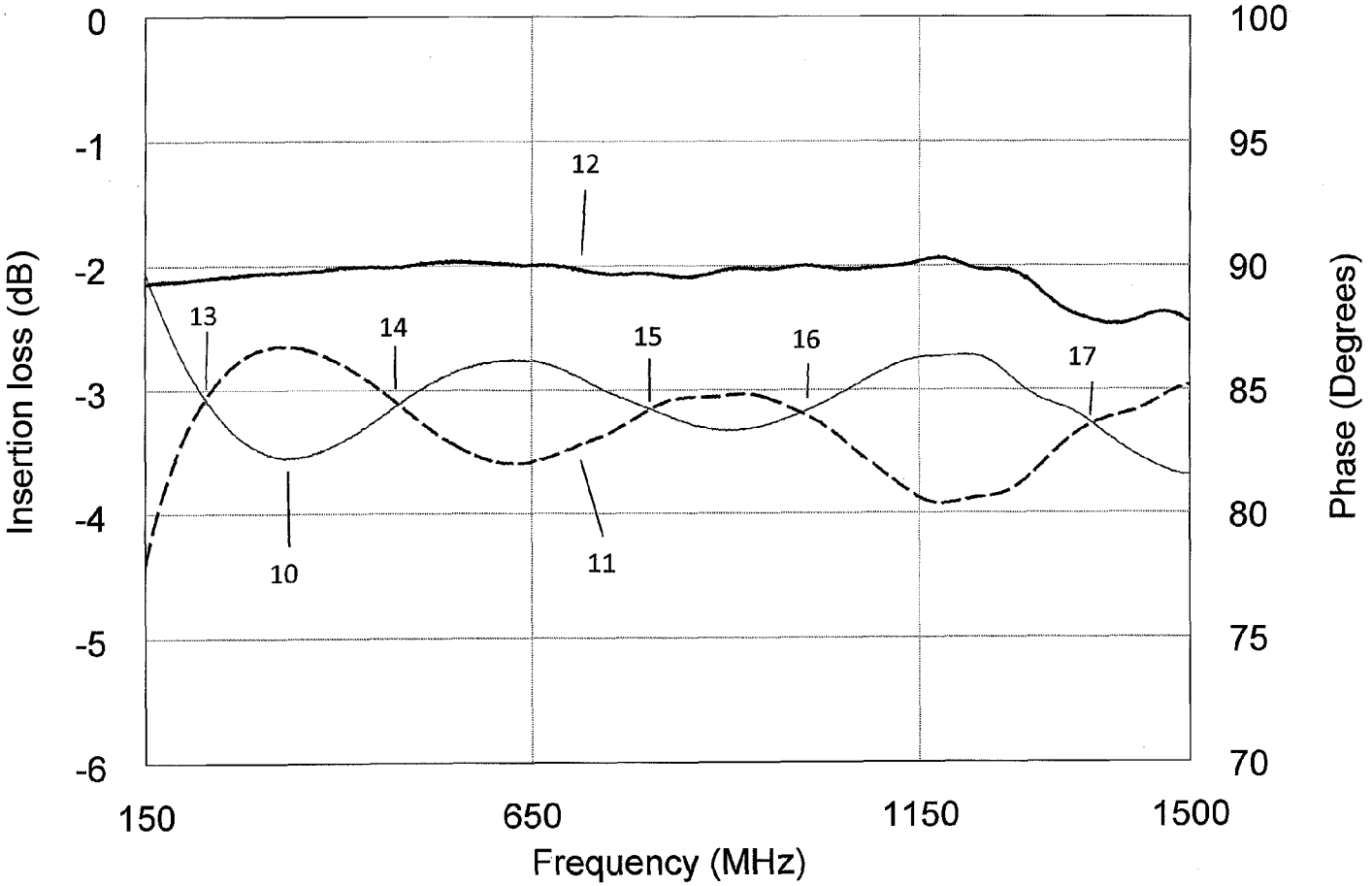
FIG. 3 illustrates an example of amplitude and phase performance of a wide bandwidth quadrature hybrid coupler.

In a preferred embodiment, the quadrature hybrid couplers 3 and 7 have similar characteristics. As illustrated in FIG. 3, each coupler exhibits amplitude crossovers 13-17 of insertion losses 10 across terminals P1 to P2 with insertion losses 11 across terminals P1 to P3. One of the amplitude crossovers in each coupler is designed to coincide with the center of a reject frequency band, fn, of the matched pair of band-reject filters 5 and 6. The phase shifter 4 is also designed to have a phase shift of 180 degrees at frequencies in the reject frequency band. At frequencies in the pass band, the phase shift of 4 can tolerate deviations from 180 degrees by as much as plus or minus 20 degrees with less than 1 dB of additional insertion loss. This requirement allows the phase shifter to be realized with low losses and low cost since it is only required to retain the 180 degree phase shift in a very narrow frequency range centered at fn.

Figure 4:
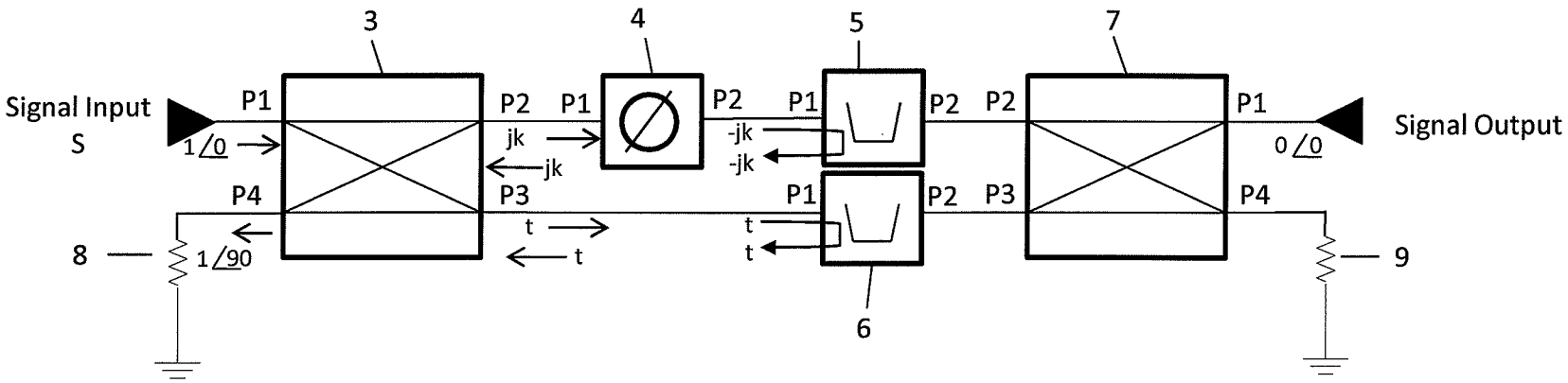
FIG. 4 shows the signal flow through the absorptive band-reject filter for frequencies in the reject band.

FIG. 4 illustrates the flow of signals that create the absorptive properties of the band-reject filter. For simplicity, the quadrature hybrid couplers 3 and 7 are selected to be identical in performance and the band-reject filters 5 and 6 are also selected to be identical in performance with respect to a reject frequency band having a center frequency fn. A signal S with a magnitude of 1 and phase of 0 degrees is injected into the P1 port labeled Signal Input of the first quadrature hybrid coupler 3. Quadrature hybrid coupler 3 divides the signal that enters port P1 into two signal components. The first of the two signal components is shifted in phase by 90 degrees from the second signal component and exits terminal P2 of quadrature hybrid coupler 3 with a value of jk. The second signal component exits terminal P3 with a value of t, where $k^2+t^2=1$. Typically, the magnitudes of k and t are 0.7071 and 0.7071, respectively, also designated as −3 dB on a logarithmic scale. The first signal component jk continues on and enters terminal P1 of phase shifter 4 where it is shifted an additional 180 degrees in phase and exits terminal P2 with a value of −jk, and enters terminal P1 of band-reject filter 5. The second signal component t of quadrature hybrid coupler 3 exits terminal P3 and enters terminal P1 of band-reject filter 6. If the frequency of signal S is in the reject frequency band of band-reject filters 5 and 6, then the first signal component reflects back out of terminal P1 of band-reject filter 5 and propagates to terminal P2 of phase shifter 4, where it shifts another 180 degrees and exits terminal P1, and enters terminal P2 of quadrature hybrid coupler 3 with a value of jk. The signal divides after entering terminal P2 of quadrature hybrid coupler 3 between the paths to terminals P1 and P4. The divided signal propagating to P1 has a value of $-k^2$. The second signal component t is also reflected back out of terminal P1 of band-reject filter 6 and enters terminal P3 of quadrature hybrid coupler 3 with a value of t. It also divides between the paths to terminals P1 and P4 of quadrature hybrid coupler 3. The divided signal propagating to terminal P1 has a value of $t^2$. The two signals that are reflected to terminal P1 of quadrature hybrid coupler 3 therefore cancel to 0 if t=k and their phase difference is 180 degrees. This eliminates reflections and creates the absorptive characteristic of the band-reject filter.

The absorptive response in the reject frequency band depends on cancellation of the two reflected signal components to port P1 of quadrature hybrid coupler 3. The two reflected signal components will cancel at port P1 if their amplitudes are equal, which occurs at the 3 dB amplitude crossovers 13-17 shown in FIG. 3. The quadrature hybrid coupler 3 is configured so that an amplitude crossover coincides with the center frequency fn of the reject frequency band. Should fn fall into a frequency region that is not exactly at a 3 dB amplitude crossover, this will manifest itself as a higher return loss but does not overly impair the operation of the circuit topology. The phase difference of the two signal paths in the quadrature hybrid coupler 3 also must equal 90 degrees at fn and the phase shift in phase shifter 4 must be 180 degrees spanning that frequency. Since the absorptive band-reject filter is preferably designed as a reciprocal device, quadrature hybrid coupler 7 is matched to quadrature hybrid coupler 3 so that the network will be similarly absorptive with respect to signals flowing into either the Signal Input or Signal Output ports.

The absorptive response of the filter also depends on the reflected signals being dissipated in a resistive load 8 at terminal P4 of quadrature hybrid coupler 3. The portion of the reflected signal that enters terminal P2 and propagates to terminal P4 has a value of jkt. The portion of the reflected signal that enters terminal P3 and propagates to terminal P4 also has a value of jkt. The signal values add in phase with a resulting magnitude of 2kt. At the crossover frequency, they will add to a magnitude of 1, thereby being dissipated by the resistor 8 and creating an absorptive response.

Figure 5:
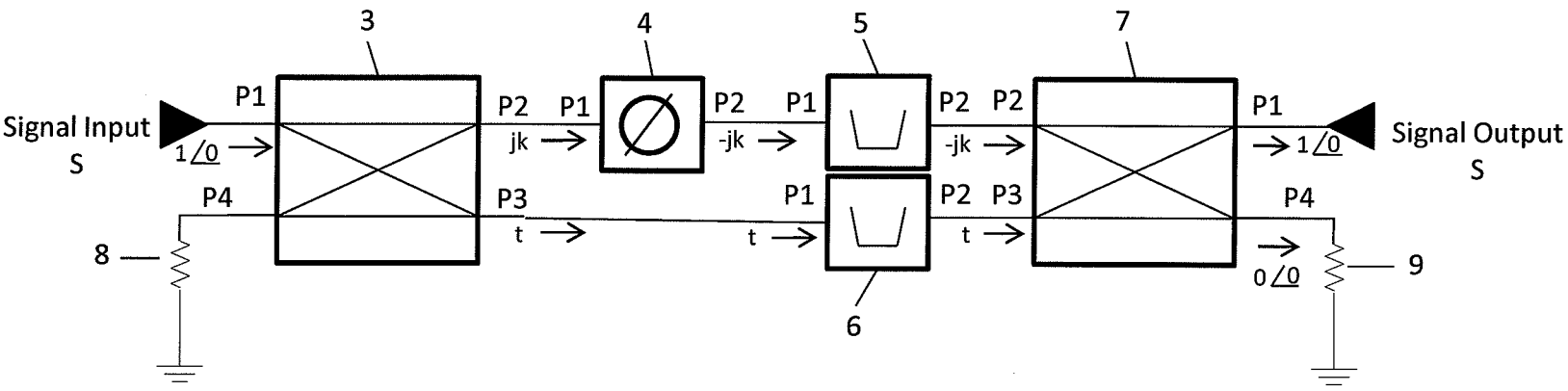
FIG. 5 shows the signal flow through the absorptive band-reject filter for frequencies over the pass-band.

If the frequency of Signal Input S is in the pass-band of the filter, the two signal components that enter band-reject filter 5 and 6 and will pass through with minimal change in amplitude and phase difference, as shown in FIG. 5. The signal component that enters terminal P2 of quadrature hybrid coupler 7 will divide between the paths to terminals P1 and P4. The divided signal that propagates to terminal P1 of quadrature hybrid coupler 7 has a value of $k^2$. The signal component that enters terminal P3 of quadrature hybrid coupler 7 also divides between the paths that propagate to terminals P1 and P4. The divided signal that propagates to terminal P1 of quadrature hybrid coupler 7 has a value of $t^2$. The two signals add constructively at terminal P1 to a value of $k^2+t^2=1$ and exit the Signal Output port P1 of quadrature hybrid coupler 7 of the same amplitude and phase as the Signal Input. The divided signals that propagate to terminal P4 of quadrature hybrid coupler 7 are 180 degrees out of phase and cancel.

Figure 1:
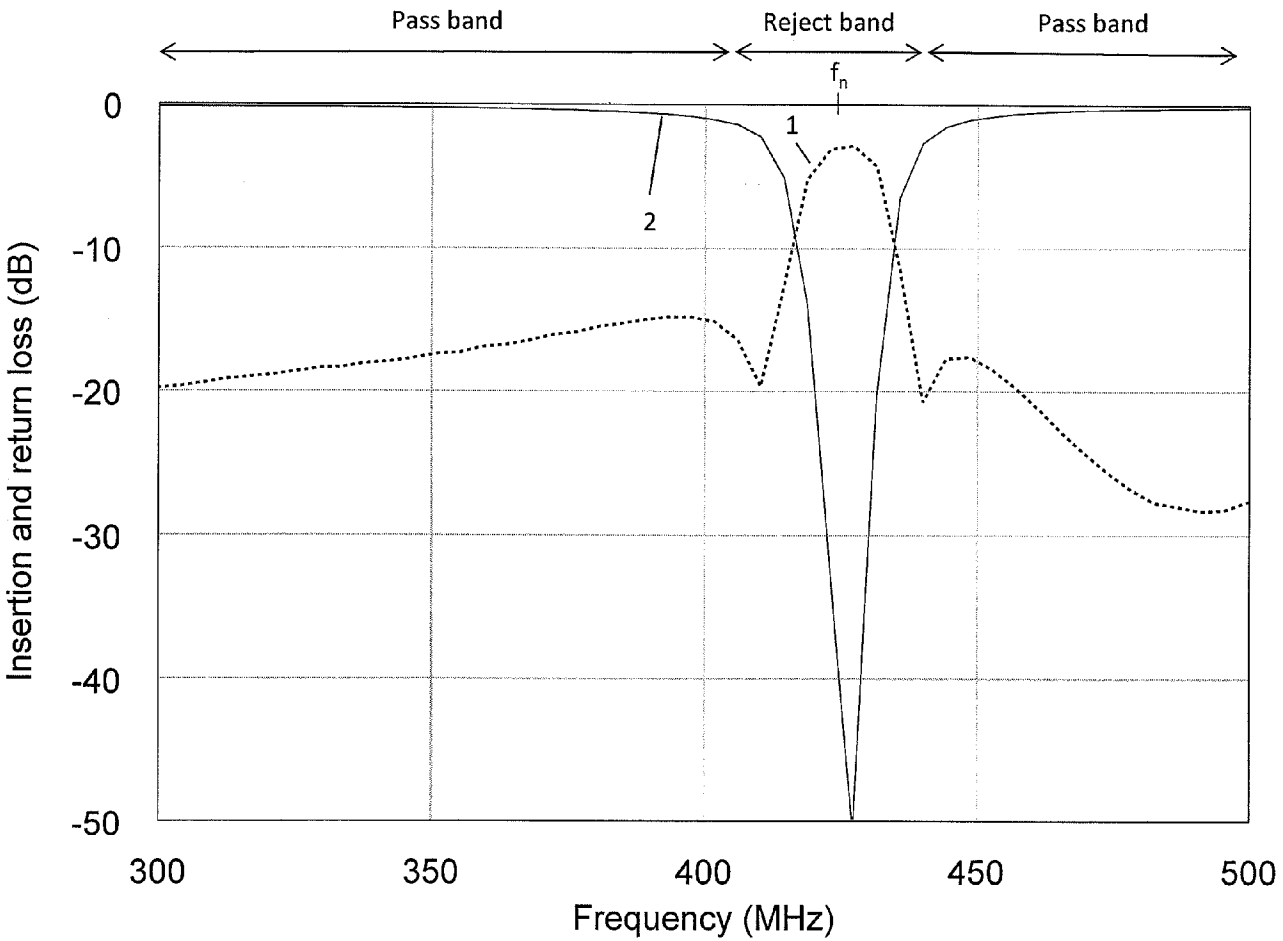
Figure 1 (Prior Art)
FIG. 1 illustrates the insertion and return losses of a conventional, reflective band-reject filter.
Figure 6:
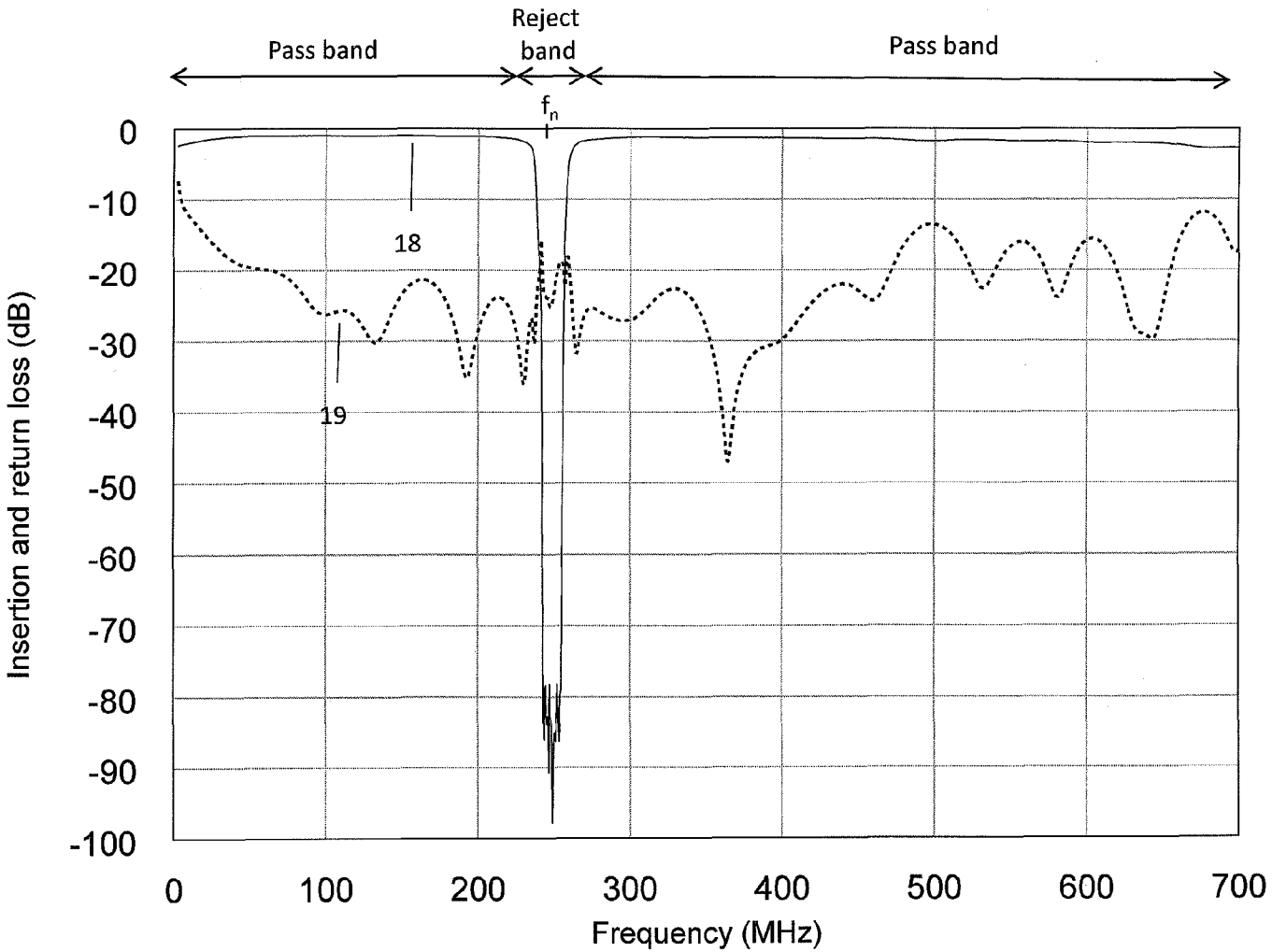
FIG. 6 shows the frequency response of the absorptive band-reject filter.

FIG. 6 illustrates a graph of the frequency response 18 of the absorptive band reject filter across the reject band and pass band. The steep rejection in the reject band is obtained due to the phase shift in phase shifter 4 being 180 degrees, the rejection of band-reject filters 5 and 6, and an amplitude crossover (13, 14, 15, 16, or 17) in each of the quadrature hybrid couplers across the reject band centered at the center frequency fn. Further, the phase difference between the P1 to P2 and P1 to P3 paths of the quadrature hybrid couplers must be equal to 90 degrees at the center frequency fn of the reject frequency band. If these conditions are met, the return losses 19 in the reject band will be very low, shown in the −20 to −30 dB range in the reject band in FIG. 6, compared to return losses in the −3 to −10 dB range in the reject band for conventional reflective band-reject filters as shown in FIG. 1. The lower return losses of the absorptive, band-reject filter mean less power is reflected back to the source of the signal S, such as a transmitter, and therefore intermodulation distortion and damage to the transmitter are avoided.

The pass response in the pass band in FIG. 6 also requires the phase shift in phase shifter 4 to be 180 degrees and the phase difference between the P1 to P2 and P1 to P3 paths of the quadrature hybrid couplers to be 90 degrees. The phase shift in phase shifter 4 can vary by as much as 20 degrees from 180 degrees in the pass band with minimal impact on the insertion loss. Also, the insertion losses in the pass band are minimally impacted even if the insertion losses 10 and 11 (in FIG. 3) are not equal as they are at the crossover frequencies. As long as the difference in loss from 3 dB in one of the paths is equal and opposite from the difference in loss from 3 dB in the other path, the insertion loss in the pass band remains low. Good pass response is obtained across very wide pass bands in the absorptive, band-reject filter since the insertion loss in the pass band is not sensitive to deviations from 3 dB through the two signal paths in the quadrature hybrid couplers 3 and 7 and deviations from 180 degrees in phase shifter 4. The absorptive band-reject filter can operate over a band-pass to band-reject frequency range ratio exceeding 100:1 and up to ranges of 4000:1 or more.

Figure 7:
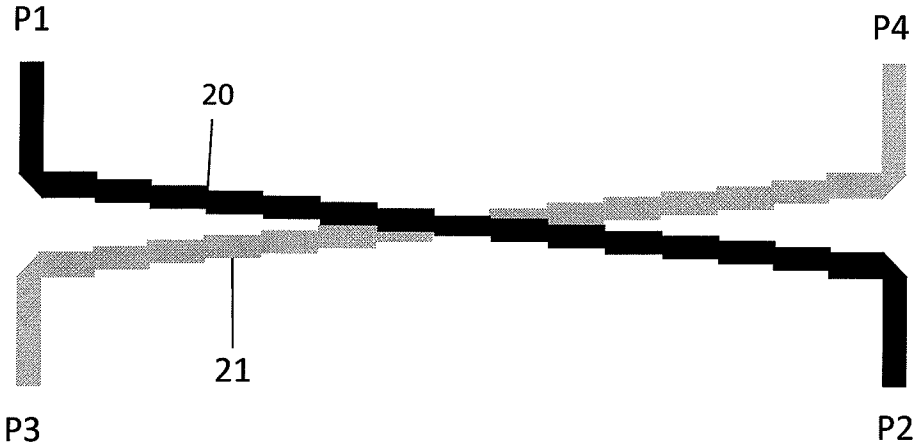
FIG. 7 illustrates a quadrature hybrid coupler formed by multi-layer striplines.

As illustrated in FIG. 7, the quadrature hybrid coupler in the ultra wide pass-band, absorptive band-reject filter of the present invention may consist of a pair of 90 degree striplines with one of the striplines 20 stacked vertically over the other stripline 21 to form the coupling region. The multi-layer stripline device may be similar to that described by Ronald P. Barbatoe in U.S. Pat. No. 3,626,332 issued on Dec. 7, 1971. A 4-port device is physically built using a multi-layer board material with top, middle, and bottom layers of dielectric material along with a top and bottom layer of conductor material. The top layer conductor 20 receives energy at port P1, also referred to as the sum port. The energy received at port P1 is propagated to port P2, also referred to as the through port. Energy is also allowed to couple from the top layer conductor 20 to the bottom layer conductor 21 at a frequency where the electrical length of the conductor is determined to be 90 degrees in signal length. At this frequency, energy is able to couple from the top conductor 20 to the bottom conductor 21, and is allowed to propagate to port P3 on the bottom conductor, also known as the coupled port. Little to no energy is allowed to propagate to port P4, also known as the isolated port. To maximize energy transfer from port P1 to ports P2 and P3, a resistor of value such as 50 Ohms is placed at port P4 to present a matched impedance at this port. This function allows equally half of the energy to propagate from port P1 to ports P2 and P3, respectively, while also allowing the phase shift between port P2 to port P3 to be 90 degrees in difference. The quadrature hybrid coupler can also be physically realized using other commonly known techniques such as lumped, distributed, waveguide, or other means, and does not specifically require stripline technology.

The quadrature hybrid coupler characteristics can be greatly simplified with the recognition that the amplitude crossover characteristics in the quadrature hybrid coupler only need to be specified within the region of reject frequency band to have an amplitude of signals propagated to terminals P2 and P3 that is equal, or approximately 3 dB. As long as this condition holds, the entire topology will behave as an absorptive filter. For all other frequencies not in the reject band, signals propagating through the entire topology will see a well-matched impedance since the quadrature hybrid couplers, phase shifter, and band-reject filters all individually present matched impedances at band-pass frequencies.

Figure 8:
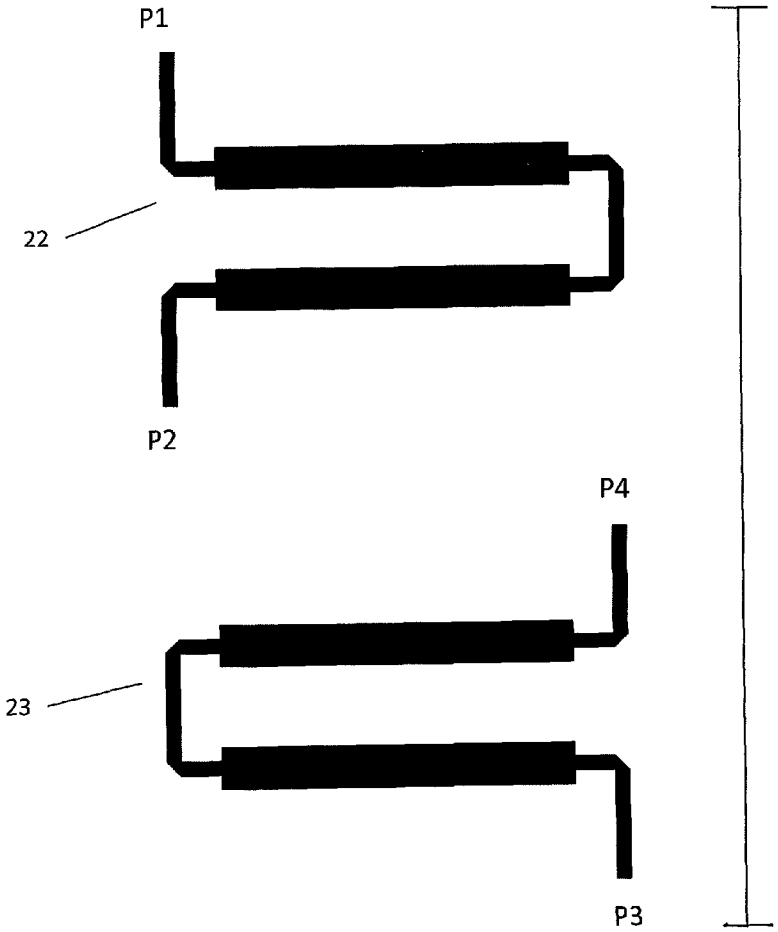
FIG. 8 illustrates a quadrature hybrid coupler with a single amplitude crossover.
Figure 9:
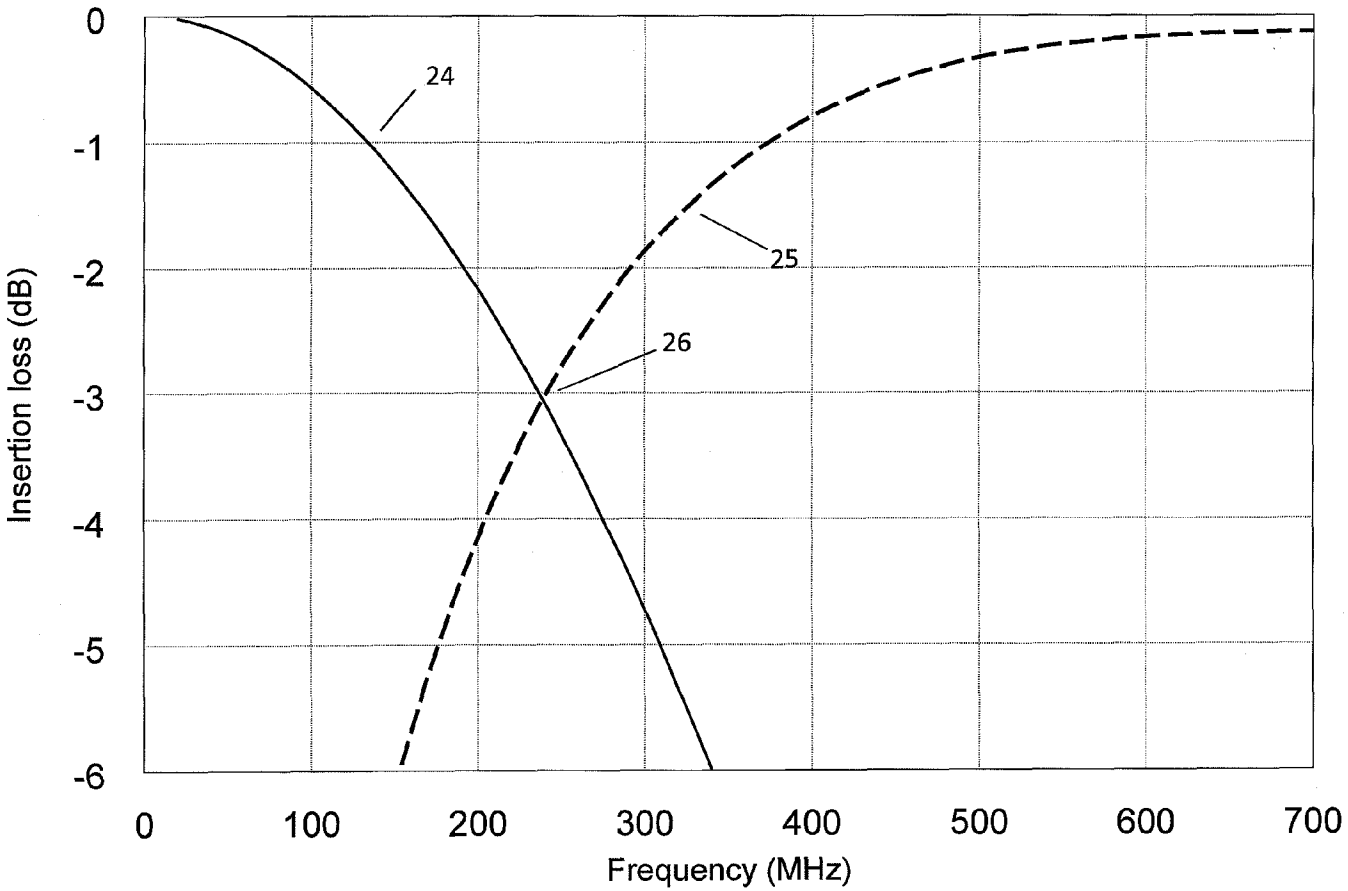
FIG. 9 illustrates the frequency response of a hybrid quadrature coupler with a single crossover.

An example of a quadrature hybrid coupler configured to have a single amplitude crossover is illustrated in FIG. 8, and its frequency response is illustrated in FIG. 9. In FIG. 8, a conductor 22 is formed in a top layer and conductor 23 in a bottom layer. In FIG. 9, the line 24 indicates the insertion loss of signal from port P1 to P2, the line 25 indicates the insertion loss of signal from port P1 to P3, and intersection 26 indicates a single crossover. The benefit of this configuration is that the bandwidth of the quadrature hybrid coupler is proportional to its insertion loss, since multiple sections in cascade are required to achieve a wideband quadrature hybrid coupler. By only requiring a single amplitude crossover, a simplified quadrature hybrid coupler can be used, thereby reducing the insertion loss of the quadrature hybrid coupler and therefore the overall topology. An example of this type of quadrature hybrid was constructed using three layers of glass reinforced hydrocarbon ceramic laminate material with a dielectric constant of 3.55 to form the multilayer stripline. The conductors shown in FIG. 8 were formed on the top and bottom sides of the middle layer of dielectric material which was sandwiched between the two other layers of dielectric material. The outer sides of the two outer layers of dielectric material were coated with a metallic surface to form the ground planes of the stripline. The entire multilayer stripline was housed in a 2.9 inch by 3.20 inch metallic enclosure.

Figure 10:
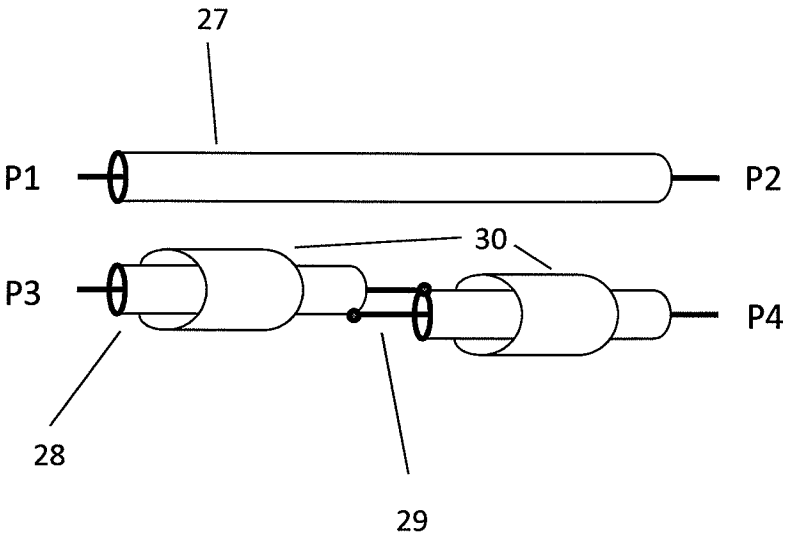
FIG. 10 illustrates a phase shifter using coaxial delay lines.

In another preferred embodiment, the phase shifter in the absorptive band-reject filter can be realized using coaxial delay lines. This embodiment is illustrated in FIG. 10 and configured as a 4-port device. An upper coaxial line 27 connecting ports P1 and P2 is referred to as the delay line. A lower coaxial line 28 connecting ports P3 and P4 is referred to as the phase shift line. In the preferred embodiment, both the delay and phase shift lines are the same length. The phase shift line 28 has a break 29 in the coaxial line whereby the inner conductor of the left-hand portion of the coaxial line is connected to the outer conductor of the right-hand portion of the coaxial line, and the inner conductor of the right-hand portion of the coaxial line is connected to the outer conductor of the left-handed portion of the coaxial line. This cross-connection inverts the flow of current flowing between the inner and outer conductor, thereby inducing a 180 degree phase shift between the delay and phase shift lines. It is common to place a sleeve of ferrite material 30 around the phase shift line to suppress surface currents flowing on the outer conductor. An example of this phase shifter was constructed using 0.085 inch outer diameter semi-rigid coaxial cable with a solid outer copper sheath. The length of the cable was minimized to avoid quarter wavelength problems. The cables were coiled into a single loop to minimize the distance between the two ends of the cable so that they could fit into a metallic enclosure that is 1.75 inches by 3.2 inches and 0.75 inches high. The phase shifter can also be physically realized using other commonly known techniques such as lumped, distributed, waveguide, or other means, and does not specifically require coaxial technology.

The band-reject filters in the absorptive band-reject filter may be conventional directly-coupled coaxial resonators. An example of a conventional band-reject filter is Model U2917 produced by Delta Microwave, Inc. at 300 Del Norte Blvd. in Oxnard, Calif.

Figure 11:
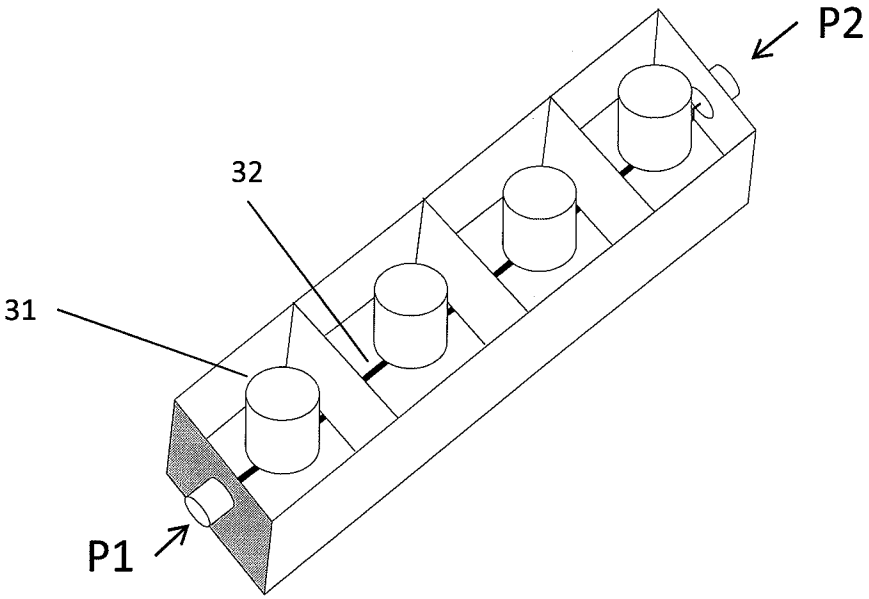
FIG. 11 illustrates a band reject filter using cavity resonators.
Figure 12:
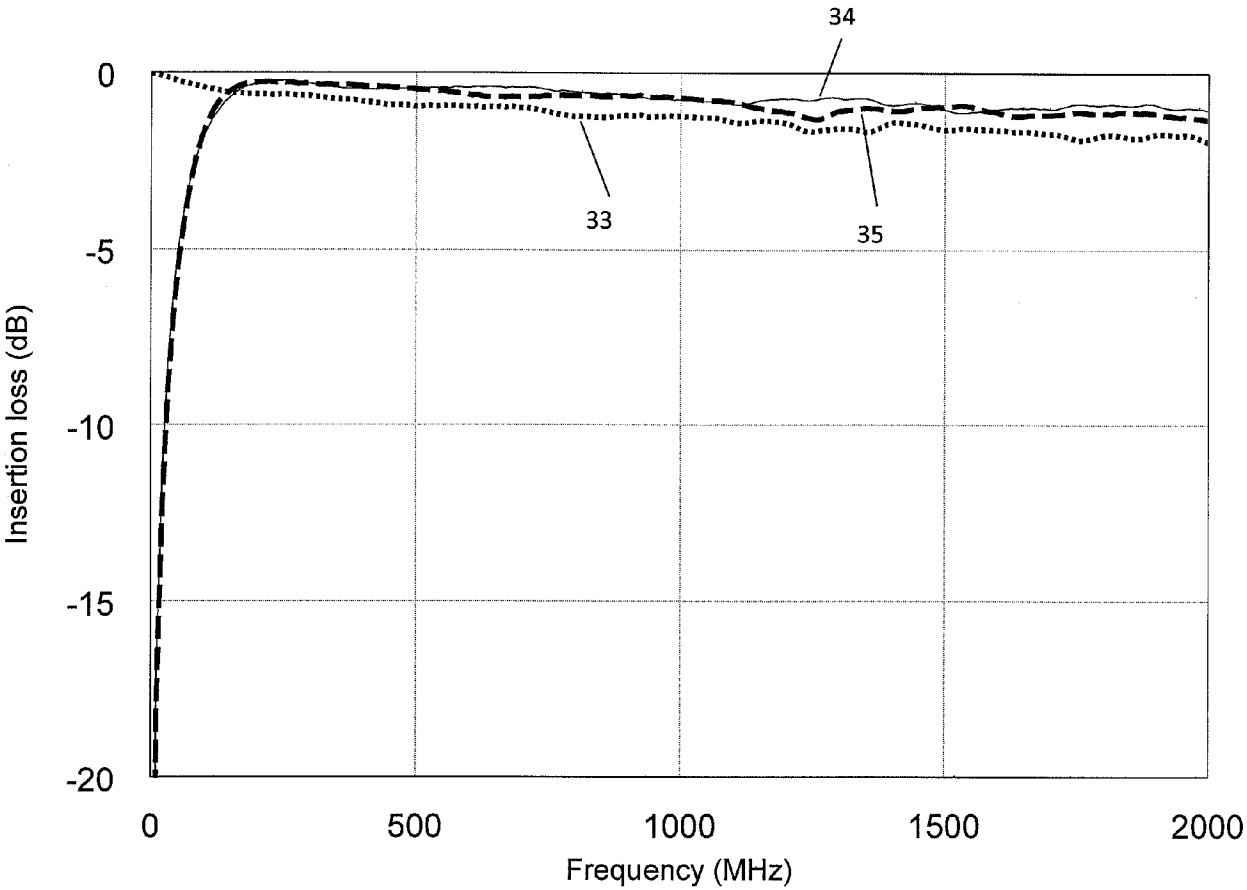
Figure 12 (Prior Art)
FIG. 12 illustrates pass-bands of three different all-pass networks.
Figure 13:
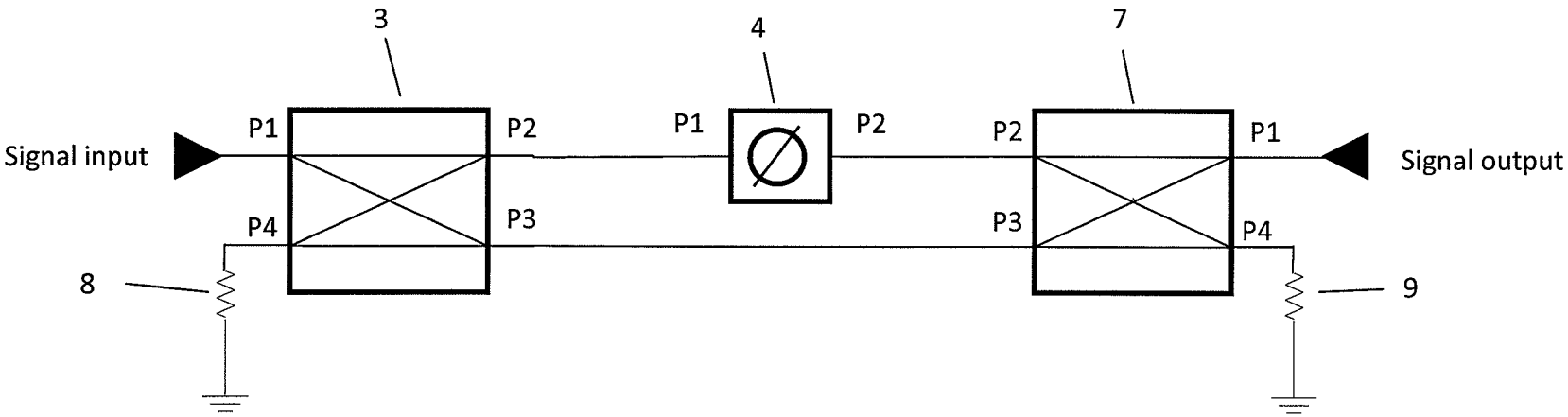
Figure 13 (Prior Art)
FIG. 13 illustrates the components in a conventional all-pass network.

In another possible embodiment, the band-reject filter can be realized using cavity resonator filter technology. This embodiment is illustrated in FIG. 11 and is configured as a two-port device. The input signal is coupled from port P1 to a first impedance inverter, commonly realized using a capacitor element. This first impedance inverter is connected to a first resonator 31, commonly realized using a cylindrical, conductive core with a hole placed in the center of the cylindrical structure. This hole is designed to have a diameter and length to operate in conjunction with the diameter and length of the cylindrical, conductive core to create a very sharp resonance at a pre-determined frequency, fn in the case of the absorptive band-reject filter. A plurality of these cylindrical, conductive resonator cores are coupled together through transmission lines 32 and a coupling structure, commonly realized using a capacitor element. This plurality of components is used to create a high-order, high rejection conventional band reject filter. The band-reject filter can also be physically realized using other commonly known techniques such as lumped, distributed, waveguide, or other means, and does not specifically require cavity resonator technology.

It is to be understood that many modifications and variations may be devised given the above description of the general principles of the invention. It is intended that all such modifications and variations be considered as within the spirit and scope of this invention, as defined in the following claims.

The invention claimed is:

1. An ultra wide band-pass, absorptive band-reject filter comprising:

a pair of quadrature hybrid couplers cascaded and coupled by a phase shifting element and a matched pair of band-reject filters in two parallel paths;

wherein a respective one of the matched pair of band-reject filters is connected in each of the parallel paths, and the phase shifting element is connected in series with the band-reject filter in one of the parallel paths, wherein each of the band-reject filters is configured to reject signals in a desired reject frequency band, the quadrature hybrid couplers each have an insertion loss amplitude crossover of signals propagated to terminals across the coupler that coincides with the reject frequency band, and the phase shifting element is selected to have a phase shift of 180 degrees at frequencies in the reject frequency band, and wherein a band-pass to band-reject frequency range ratio exceeding 100:1 and up to ranges of 4000:1 or more is obtained, whereby an absorptive rejection response is provided in the reject frequency band while a very wide pass-band frequency range is maintained.

2. An ultra wide band-pass, absorptive band-reject filter according to claim 1, wherein the quadrature hybrid couplers each exhibits similar amplitude crossovers of signal insertion losses to terminals across the coupler, and one of the amplitude crossovers in each coupler is designed to coincide with the center frequency fn of the reject frequency band.

3. An ultra wide band-pass, absorptive band-reject filter according to claim 1, wherein the pair of quadrature hybrid couplers are identical in performance and the band-reject filters are identical in performance with respect to a center frequency fn of the reject frequency band.

4. An ultra wide band-pass, absorptive band-reject filter according to claim 1, wherein the pair of quadrature hybrid couplers are matched in characteristics to each other so as to be similarly absorptive with respect to signals flowing into either the signal input or signal output thereof.

5. An ultra wide band-pass, absorptive band-reject filter according to claim 1, wherein each of the of quadrature hybrid couplers has a resistive load connected at a terminal thereof for dissipating reflected signals in the absorptive response of the filter.

6. An ultra wide band-pass, absorptive band-reject filter according to claim 1, wherein the quadrature hybrid couplers are each formed with a pair of 90-degree phased striplines with one of the striplines stacked vertically over the other stripline to form a coupling region.

7. An ultra wide band-pass, absorptive band-reject filter according to claim 1, wherein the quadrature hybrid couplers are each configured to have a single amplitude crossover of signal insertion losses to terminals across the coupler, thereby enabling a simplified quadrature hybrid coupler configuration to be used.

8. An ultra wide band-pass, absorptive band-reject filter according to claim 7, wherein the simplified quadrature hybrid coupler is constructed of three layers of dielectric material, having top and bottom conductor striplines formed on top and bottom sides of the middle layer of dielectric material sandwiched between the two other layers of dielectric material.

9. An ultra wide band-pass, absorptive band-reject filter according to claim 1, wherein the phase shifting element is formed using coaxial delay lines.

10. An ultra wide band-pass, absorptive band-reject filter according to claim 1, wherein the band-reject filters are formed using directly-coupled coaxial resonators.

11. An ultra wide band-pass, absorptive band-reject filter according to claim 1, wherein the band-reject filters are formed using cavity resonator filters.

12. An ultra wide band-pass, absorptive band-reject filter according to claim 1, which is coupled at an output of a transmitter and tuned to a reject frequency band of an adjacent receiver.

13. An ultra wide band-pass, absorptive band-reject filter according to claim 12, wherein the transmitter is a wireless transmitter for wireless devices as pagers or cellular phones, as well as for networking technology such as wireless routers.

* * * * *